United States Patent [19]

Ritzenthaler

[11] 4,167,969

[45] Sep. 18, 1979

[54] TRANSMISSION COOLER

[75] Inventor: Francis H. Ritzenthaler, Gasport, N.Y.

[73] Assignee: General Motors Corporation, Detroit, Mich.

[21] Appl. No.: 850,062

[22] Filed: Nov. 9, 1977

[51] Int. Cl.[2] ..... F01P 11/08; F28D 7/08; F28F 9/26

[52] U.S. Cl. ..... 165/51; 123/41.33; 123/196 AB; 165/76; 165/163; 165/176; 165/178

[58] Field of Search ..... 184/104 B; 123/41.33, 123/196 AB, 41.42, 41.48, 41.49; 165/51, 41, 164, 76, 163, 172, 154, 74, 176, 178; 219/208, 306, 307

[56] References Cited

U.S. PATENT DOCUMENTS

| | | | |
|---|---|---|---|
| 1,494,437 | 5/1924 | Manville | 184/104 B |
| 1,826,169 | 10/1931 | Douglass, Jr. | 165/178 |
| 1,931,935 | 10/1933 | Paugh | 123/196 AB |
| 2,188,172 | 1/1940 | Brehob | 184/104 B |
| 3,234,884 | 2/1966 | Gearn | 165/74 |
| 3,417,920 | 12/1968 | Tyson | 165/51 |

FOREIGN PATENT DOCUMENTS

| | | | |
|---|---|---|---|
| 2337476 | 7/1973 | Fed. Rep. of Germany | 123/41.33 |
| 274535 | 7/1927 | United Kingdom | 184/104 B |
| 492155 | 9/1938 | United Kingdom | 219/208 |

*Primary Examiner*—Sheldon Jay Richter
*Attorney, Agent, or Firm*—R. L. Phillips

[57] ABSTRACT

A compact yet efficient auxiliary transmission oil cooler of simple design and adapted to be installed within the engine coolant hose of a vehicle. The oil cooler consists of two basic parts. The first part is an outer tubular sleeve that serves as a housing and has opposite open ends adapted to be attached at its ends to a radiator hose for passage of coolant through the tube. The second part is the oil passage means to accomplish heat transfer to the coolant and it consists of a tubular member having a plurality of generally parallel runs or passes extending inside the coolant hose.

2 Claims, 6 Drawing Figures

TRANSMISSION COOLER

Present transmission oil coolers utilize an air-to-liquid type heat exchanger. In this type of heat exchanger, air flowing through the grill of the vehicle also flows through the oil cooler and oil from the transmission passes through tubes in the heat exchanger. This type of cooler is difficult to install and there is often no good location for the interception of relatively low temperature air. In addition, mounting brackets must be utilized to fasten the cooler to the vehicle.

The subject oil cooler eliminates the aforementioned problems of air-to-liquid coolers. In contrast to air-to-liquid type coolers, the subject oil cooler is liquid-to-liquid heat exchanger which is known to be more efficient for a given size than the other type. Also, the subject oil cooler is simple and compact and is designed to be located within the engine coolant hose, thus eliminating the need for mounting brackets. In addition, the subject oil cooler is easy to install and only requires a cut in the radiator hose and insertion of the oil cooler within the hose interior followed by a clamping of the ends of the hose to the ends of the oil cooler housing.

More advantages and features of the subject invention will be more readily apparent after a reading of the following detailed description, reference being had to the accompanying drawings in which preferred embodiments are illustrated.

IN THE DRAWINGS

Figure 1:
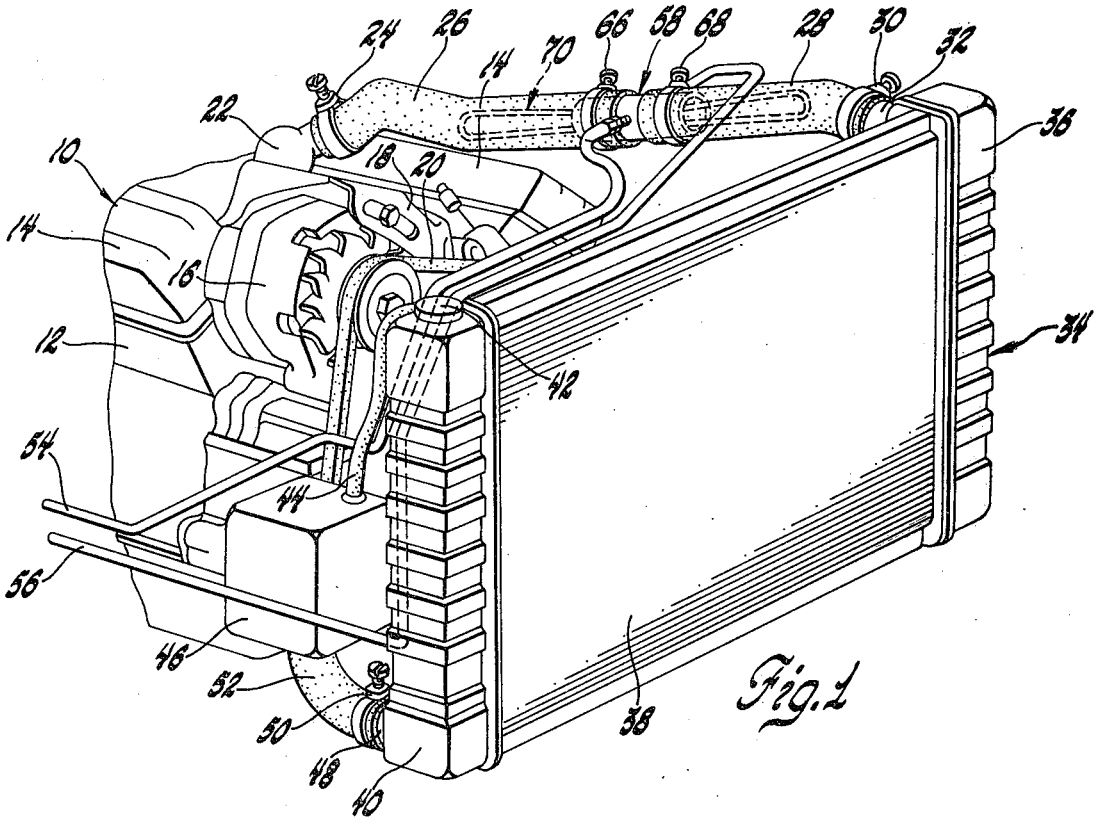
FIG. 1 is a perspective view of the forward portion of a vehicle engine and the cooling system with the subject oil cooler in place.

In FIG. 1 of the drawings, a vehicle internal combustion engine 10 is partially illustrated. The engine 10 has a block portion 12, valve covers 14 and alternator 16 which is supported by a bracket 18 and driven by the engine crankshaft through a belt 20. The block 12 has water passages therein for cooling purposes and the water or coolant therefrom is discharged from the engine through an outlet fitting or thermostatic housing 22. The housing 22 is attached by clamps 24 to a coolant hose 26. The forward end portion 28 of the coolant hose is connected by a clamp 30 to an inlet fitting 32 of the vehicle radiator 34. The inlet fitting 32 is fluidly connected to an inlet header tank 36 which extends vertically on one side of the radiator. A central portion 38 of the radiator 34 is made up of parallel tubes which extend horizontally from the inlet header tank 36. Located between the tubes are serpentine fins or centers for increasing the rate of heat transfer from the coolant in the tubes to air passing through the portion 38 of the radiator.

The radiator 34 includes an outlet header tank 40, similar to tank 36, located at the end of the radiator opposite tank 36. The header tank 40 supports a fill cap 42 which normally covers a fill opening. An overflow hose 44 extends from the fill opening and is connected to a storage tank 46 mounted next to the radiator. When coolant in the radiator expands due to heating, the excess coolant flows through tube 44 and into the tank 46. Conversely, when coolant contracts, the flow is back into the radiator. An outlet fitting 48, similar to fitting 32, is fluidly connected to the tank 40 and is located at the bottom of the outlet header tank 40. Fitting 48 is attached by a clamp 50 to a second radiator hose 52 whose other end is fluidly connected and attached to the engine water pump (behind the radiator).

Many modern vehicles transmit engine torque through an automatic hydraulic transmission and the oil in the transmission must be cooled during operation. A small pump is provided in the transmission to pump the oil to a cooler. This pump is adapted to be connected to external discharge and return oil lines 54, 56 of FIG. 1. The oil lines 54, 56 extend toward the front of the engine and then upward and laterally to the two radiator or coolant hoses 26. The subject oil cooler is illustrated as the sole oil cooler in FIG. 1. It may also be used in series with an oil cooler in the header tank 40. Presently, an oil cooler in the tank 40 is utilized in automatic transmission equipped vehicles sold by General Motors.

Figure 2:
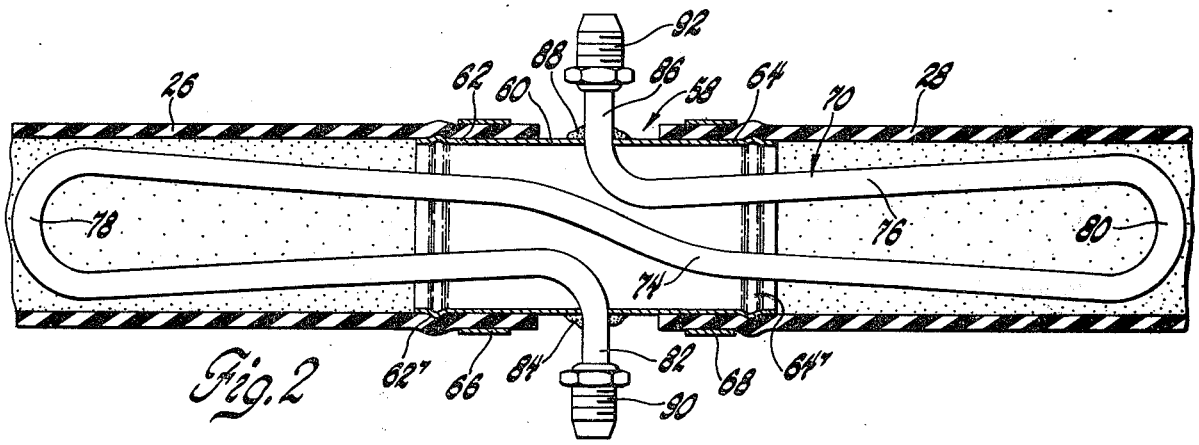
FIG. 2 is a sectioned view of the oil cooler shown in FIG. 1.

The oil cooler 58 is illustrated in more detail in FIG. 2 and includes a outer tube or housing 60 with opposite end portions 62, 64 adapted to be connected to the radiator hose portions 26, 28. The connection is made leak proof by encircling clamp members 66, 68 which press the hose portions 26, 28 against the end portions 62, 64. Circular ridges 62' and 64' help provide a leakless fit. As described so far, the housing 60 is a tubular member permitting engine coolant to flow therethrough between the thermostat housing 22 and the inlet 32 of the radiator 34.

Transmission oil is passed through a tubular heat exchanger 70 which is formed by a continuous conduit member as shown in FIG. 2. Member 70 has a plurality of relatively straight passes or portions 72, 74, 76 which are integrally joined by the curved end portions 78, 80. Specifically, the oil line 54 is connected to end portion 82 of the heat exchanger tube 70. End portion 82 projects through the wall of the tubular housing 60 and is brazed to the housing 60 as labeled by the numeral 84. Likewise, the other end portion 86 of tube 70 extends through housing tube 60 at a diametrically opposite location and is brazed thereto as indicated by numeral 88. Threadable fittings 90, 92 permit attachment to the oil lines 54, 56.

The aforedescribed auxiliary cooler is simple, compact and light yet efficient. Because tube 70 functions as a mild restrictor in the radiator hose, coolant at a high velocity passes over the tube portions 72, 74 and 76 with resulting turbulence. This increases heat transfer between oil in the tube and coolant passing thereover. Furthermore, the location of the oil cooler within the radiator hose makes installation simple and even an add-on type installation possible. No bracket fabrication is needed and no existing vehicle components need be removed. The oil cooler is adapted for insertion in the radiator hose and can be installed where the hose configuration is other than the straight section shown in FIG. 1. The heat exchange tubes 70 may be bent to a considerable degree to conform with practically any radiator hose configuration. To install, coolant is drained so that the upper radiator hose can be cut to form two sections 26, 28 and two separated ends. The tube portions 70 are inserted into the open ends of the hose and then the hose ends are worked over the end portions 62, 64 of the oil cooler housing 60. Next, clamps 66, 68 are tightened about the ends of the radiator hose and the housing to provide a non-leaking connection therebetween. Finally, the transmission oil lines are connected to fittings 90, 92 and the installation is completed.

Figure 3:
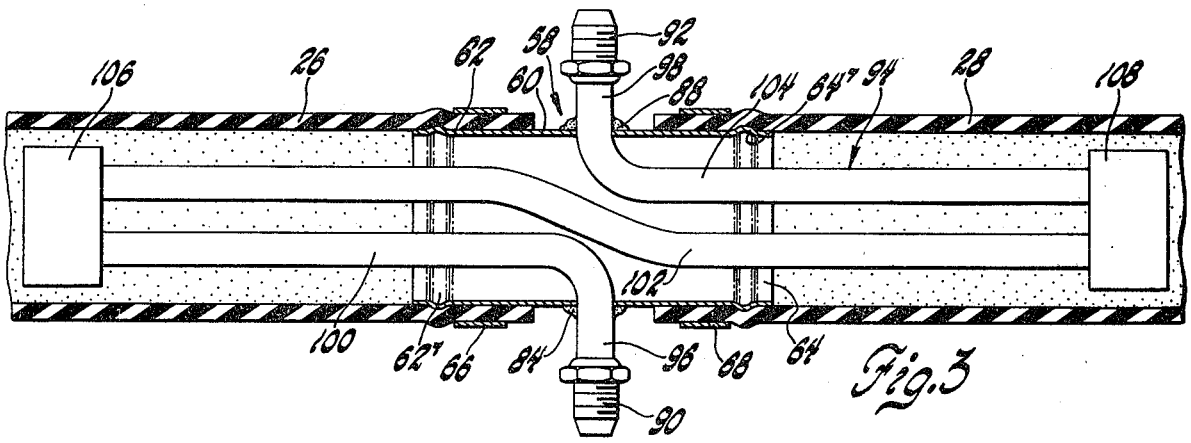
FIGS. 3-6 are like FIG. 2 and illustrate other embodiments of the subject auxiliary oil cooler.

In FIG. 3, an oil cooler is illustrated and includes parts which are shared with the cooler shown in FIG. 2 and are numbered the same. The difference between the embodiments is in the heat exchanger tube portions 70 and 94. Tube 94 includes end portions 96, 98 which extend through the wall of the housing 60 and are brazed thereto at 84 and 88. Substantially parallel passes 100, 102 and 104 are fluidly connected at their ends to form a continuous fluid passage from end 96 to end 98 by means of reversing manifolds 106, 108. The manifolds 106, 108 have inlet and outlet aperatures into which the ends of sections 100, 102 and 104 are inserted and brazed. The manifolds produce a solid connection between the tube passes and this means of fabrication is particularly advantageous over that shown in FIG. 2 when the diameter of the coolant hose is small such that a curved end portion as shown would be difficult to form.

Figure 4:
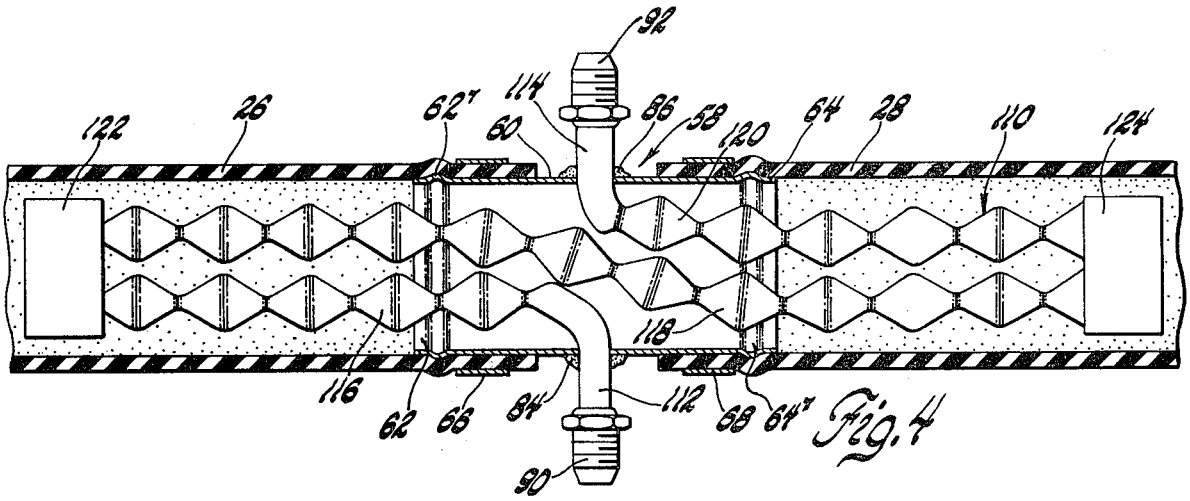

FIG. 4 illustrates an oil cooler similar to the embodiment shown in FIG. 3 and common parts are labeled the same. The primary difference between the embodiment shown in FIG. 4 and the embodiments shown in FIGS. 2 and 3 is in the heat transfer tube 110 as illustrated in FIG. 4. The tube 110 is formed from partially flattened and twisted tubular stock so that a mild restriction to oil flow is formed. This restriction produces turbulence of oil therethrough. Again, as in FIG. 2, the tube 110 is composed of ends 112 and 114 and tube passes 116, 118 and 120. The ends of the passes are joined by reverse manifolds 122 and 124. These manifolds are similar to the manifolds previously discussed in connection with the embodiment shown in FIG. 3. This produces many oblique surfaces for the coolant flow passing through the hose to increase oil turbulence.

Figure 5:
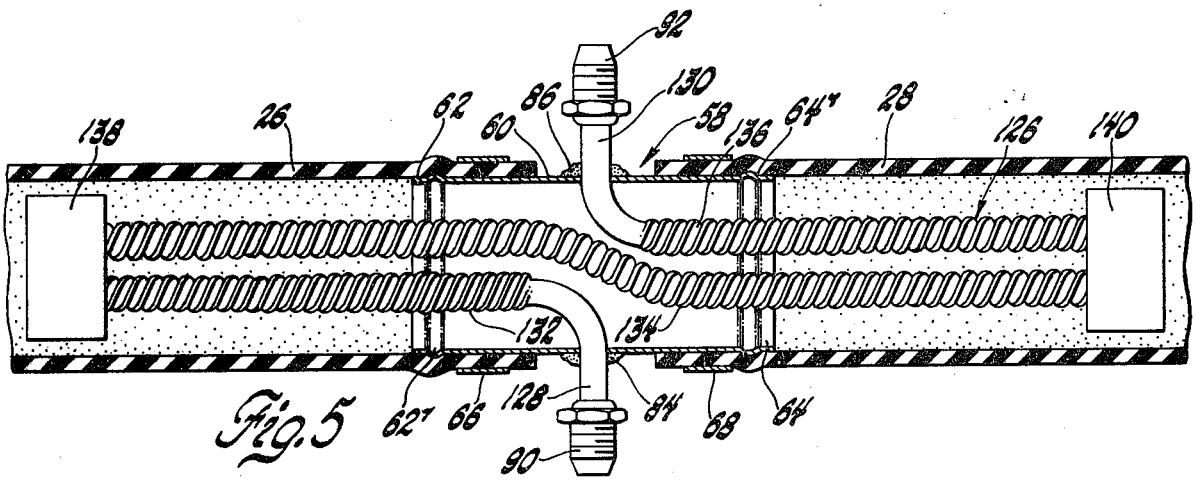

The embodiment shown in FIG. 5 is similar to the embodiments shown in FIGS. 2 and 3 and common parts are labeled the same. The primary difference between the embodiments is in the heat transfer tube 126 shown in FIG. 5. Tube 126 has ends 128, 130 joined to housing 60 by braze joints 84, 86. Generally parallel tube sections or passes runs 132, 134 and 136 extend between ends 128, 130. The tube passes 132, 134 and 136 are connected by reverse manifold members 138, 140. The configuration of tube passes 132, 134 and 136 is of tubular shape with a spirally rolled ridge therein which is particularly good for increasing oil and coolant turbulence to therefore increase potential heat transfer.

Figure 6:
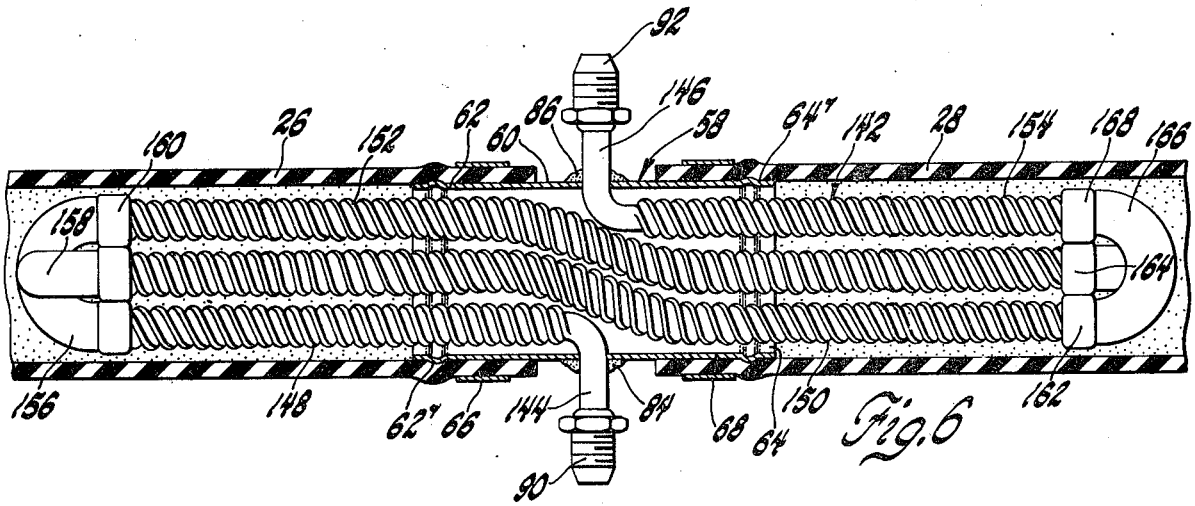

Finally, the embodiment shown in FIG. 6 is similar to the embodiment shown in FIGS. 2 and 5 and common parts have been labeled the same. The difference is in the heat transfer tube 142 within the radiator hose. The tube portion 142 has end portions 144, 146 extending through housing 60 and brazed at 84, 86. Generally parallel tube sections or passes 148, 150, 152 and 154 extend between ends 144, 146. The passes are formed of the same spirally configured tube stock as disclosed in FIG. 5. The run 148 is connected to a reverse curved member 156 having branched outlet portions 158, 160. These are connected respectively to the sections 150 and 152. Likewise, the other ends of sections 150 and 152 are connected to a dual inlet 162 and 164 of a reverse curved connector 166. The outlet 168 of the connector 166 is attached to the section or pass 154 which extends to end portion 146. Thus, in FIG. 6, an additional oil pass is provided the full length of the oil cooler to increase the rate heat exchange. The oil cooler represented by the embodiment of FIG. 6 would be particularly well adapted for use in a large diameter radiator hose under severe operating conditions of the vehicle.

Although several embodiments of the subject oil cooler have been described and illustrated, there are modifications contemplated which would not place the modified device outside the scope of the following claims which define the invention.

What is claimed is as follows:

1. An oil cooler for vehicles of the type having a liquid cooled engine including a radiator and a coolant hose of elastomeric material between the engine and radiator, comprising: a tubular housing with opposite open ends adapted to be inserted in a leak-resistant manner between intermediate end portions formed in the hose so that engine coolant is required to flow through said tubular housing between the engine and radiator; an elongated heat exchange means including an inlet and outlet portion extending through the wall of said tubular housing for receiving oil from and discharging oil to a remote oil heating means, a mid-portion of said heat exchange means including a plurality of substantially parallel tube passes extending longitudinally through said housing past the open ends thereof and a substantial distance into and along the length of the interior of the coolant hose and between said inlet and outlet portions of the heat exchange means and in direct fluid contact with engine coolant flowing thereby.

2. An oil cooler for vehicles of the type having a liquid cooled engine including a radiator and a coolant hose of elastomeric material between the engine and radiator, comprising: a tubular housing with opposite open ends adapted to be connected respectively to portions of the coolant hose extending to the engine and the radiator so as to require engine coolant to pass through said tubular housing; an elongated heat exchange means including an inlet and an outlet portion extending through the wall of said tubular housing for receiving oil from and discharging oil to a remote oil heating means, a mid-portion of said heat exchange means including a plurality of substantially parallel tube passes extending longitudinally through said housing past the open ends thereof and a substantial distance into and along the length of the interior of the coolant hose, one end of one of the tube passes being fluidly connected to said inlet portion and one end of another one of the tube passes being fluidly connected to said outlet with the other ends being fluidly connected in flow relation so as to pass oil between the inlet and outlet while heat is extracted therefrom through the walls of the tube passes by coolant flowing thereover.

* * * * *